US010159868B2

(12) United States Patent
Light et al.

(10) Patent No.: US 10,159,868 B2
(45) Date of Patent: Dec. 25, 2018

(54) BAR-BELL DESIGN WITH ROTATABLE HAND GRIPS

(71) Applicant: BODYROCKTV INC., Kingston, Ontario (CA)

(72) Inventors: Frederick Light, Kingston (CA); Sean Light, Kingston (CA)

( * ) Notice: Subject to any disclaimer, the term of this patent is extended or adjusted under 35 U.S.C. 154(b) by 0 days.

(21) Appl. No.: 15/754,359

(22) PCT Filed: Jul. 28, 2017

(86) PCT No.: PCT/CA2017/050911
§ 371 (c)(1),
(2) Date: Feb. 22, 2018

(87) PCT Pub. No.: WO2018/018159
PCT Pub. Date: Feb. 1, 2018

(65) Prior Publication Data

US 2018/0243605 A1 Aug. 30, 2018

Related U.S. Application Data

(60) Provisional application No. 62/367,921, filed on Jul. 28, 2016.

(51) Int. Cl.
*A63B 21/00* (2006.01)
*A63B 21/06* (2006.01)
*A63B 21/072* (2006.01)

(52) U.S. Cl.
CPC ..... *A63B 21/4035* (2015.10); *A63B 21/06* (2013.01); *A63B 21/072* (2013.01); *A63B 21/0724* (2013.01); *A63B 21/00058* (2013.01); *A63B 21/00065* (2013.01); *A63B 2225/09* (2013.01)

(58) Field of Classification Search
CPC ..... A63B 21/4035; A63B 21/0724; A63B 21/00065; A63B 21/06; A63B 21/072; A63B 21/00058
See application file for complete search history.

(56) References Cited

U.S. PATENT DOCUMENTS 4,618,143 A 10/1986 Twardosz
RE33,218 E * 5/1990 Twardosz ..... A63B 21/0724 482/106

(Continued)

OTHER PUBLICATIONS

International Search Report dated Oct. 25, 2017 in corresponding International Application No. PCT/CA2017/050911 , 3 pages.

*Primary Examiner* — Megan Anderson
(74) *Attorney, Agent, or Firm* — Carter, DeLuca, Farrell & Schmidt, LLP

(57) ABSTRACT

A weight lifting apparatus is provided and includes a pair of weight supports, a pair of handle assemblies coupled to the pair of weight supports, and a central bar interposed between each handle assembly of the pair of handle assemblies. The central bar is coupled to each handle assembly. Each handle assembly includes a handle housing, a grip that is rotatably supported within the handle housing, and a ratchet pawl. The ratchet pawl is selectively manipulatable from a first position that inhibits rotation of the grip relative to the handle housing to a second position that permits rotation of the grip relative to the handle housing.

14 Claims, 11 Drawing Sheets

(56) References Cited

U.S. PATENT DOCUMENTS

| | | | | |
|---|---|---|---|---|
| 5,024,434 | A * | 6/1991 | Smith | A63B 21/0724 482/106 |
| 5,158,519 | A | 10/1992 | Hughes | |
| 5,407,405 | A | 4/1995 | Oren | |
| 7,025,713 | B2 | 4/2006 | Dalebout et al. | |
| 7,094,182 | B1 | 8/2006 | Holten | |
| 7,955,157 | B1 * | 6/2011 | Hedeen, Jr. | A63B 21/157 446/236 |
| D671,996 | S * | 12/2012 | Wierszewski | D21/680 |
| 8,672,815 | B1 * | 3/2014 | Springer | A63B 21/0724 482/106 |
| 2013/0035218 | A1 * | 2/2013 | Wierszewski | A63B 21/072 482/106 |

* cited by examiner

BAR-BELL DESIGN WITH ROTATABLE HAND GRIPS

CROSS-REFERENCE TO RELATED APPLICATION

The present application is a U.S. National Stage Entry of International Application No. PCT/CA2017/050911, filed on Jul. 28, 2017, which claims the benefit of, and priority to, U.S. Provisional Patent Application Ser. No. 62/367,921 filed on Jul. 28, 2016, the entire contents of each which are hereby incorporated by reference herein.

BACKGROUND

Technical Field

The present disclosure relates to exercise equipment, and more particularly, to a bar-bell apparatus having adjustable hand grips for use in weight training.

Description of Related Art

Exercising on a regular basis not only strengthens the body, but also the mind. The numerous benefits of physical activity have given rise to the increasing means by which individuals may keep active. Although one of the oldest types of strength training, resistance or weight training remains one of the most important and popular types of strength training today. Originally using stones and in some instances, calves, weight training has experienced numerous innovations throughout history enabling more efficient and safe training while providing an increasing variation in the means by which one may train.

Early innovations in weight training, and more specifically in free weights, include the halteres developed in Greece in the $2^{nd}$ century, later evolving into dumbbells, and the $19^{th}$ century development of the bar-bell. Common to these types of devices is a fixed bar or grip by which the user grasps the device to lift and manipulate. Varying the angle by which the user grasps the grip relative to the axis of the bar can change the muscle that is most affected by lifting the weight, as well as reduce strain on ligaments and tendons. Although dumbbells enable the user to infinitely vary this angle, bar-bells typically include a grip that is fixed relative to the axis of the bar. Thus, in order to target different muscles, the user typically uses a different type of bar for each muscle. Specifically, a straight bar is typically used for general lifting, such as the bench press. To target the biceps, a curling bar is used. These bar-bells typically include a slight wave or bend in the bar at each grip area to rotate the users hands relative to the axis of the bar, reducing the strain placed on the user's wrists while simultaneously increasing the effect of the exercise on the biceps. To target the triceps, a tricep bar is used, having a pronounced wave or bend at each grip to further rotate the user's hands relative to the axis of the bar. Another common type of bar is the Swiss bar which includes grips that are transverse to the axis of the bar, which reduces the strain placed on the user's shoulders.

As can be appreciated, in order to achieve each of these effects a user must have access to each of the above types of bar-bells, which is both expensive and consumes a significant amount of space. In many instances, a user is only able to obtain access to these different types of bar-bells at a gym or other type of strength training facility.

SUMMARY

The present disclosure is directed to a weight lifting apparatus including a pair of weight supports, a pair of handle assemblies coupled to the pair of weight supports, and a central bar interposed between each handle assembly of the pair of handle assemblies and coupled thereto. Each handle assembly includes a handle housing, a grip that is rotatably supported within the handle housing, and a ratchet pawl. The ratchet pawl is selectively manipulatable from a first position that inhibits rotation of the grip relative to the handle housing to a second position that permits rotation of the grip relative to the handle housing.

In aspects, the ratchet pawl may be slidably disposed within a portion of the grip.

In certain aspects, the handle housing may define a pair of housing half-sections, each housing half-section defining an arcuate first surface and a planar second surface disposed opposite to the arcuate first surface.

In other aspects, the planar second surface may define a counterbore therein. An inner surface of the counterbore defines a plurality of bosses extending therefrom and arranged circumferentially thereon.

In certain aspects, each boss of the plurality of bosses may be spaced apart from one another to form a corresponding plurality of channels therebetween, wherein when in the first position, the ratchet pawl is configured to be received within a channel of the plurality of channels to inhibit rotation of the grip relative to the handle housing.

In aspects, an outer surface of the grip may define a slot therein that is configured to slidably receive the ratchet pawl therein.

In other aspects, the weight lifting apparatus may include a ratchet pawl biasing element that is interposed between the ratchet pawl and a surface of the slot of the grip. The ratchet pawl biasing element is configured to bias the ratchet pawl into engagement with a channel of the plurality of channels of the handle housing half-sections.

In aspects, the ratchet pawl may be slidably disposed within a portion of the center bar.

In certain aspects, the grip may define a pair of half-sections, each half-section defining an arcuate first surface and a planar second surface disposed opposite to the arcuate first surface.

In aspects, the planar second surface may define a plurality of slots therein extending through the arcuate first surface and arranged circumferentially thereon.

In other aspects, each slot of the plurality of slots may be spaced apart from one another. Each slot of the plurality of slots is configured to receive a portion of the ratchet pawl therein to inhibit rotation of the grip relative to the handle housing.

In certain aspects, the handle housing may define a pair of handle housing half-sections. Each handle housing half-section may define an arcuate first surface and a planar second surface that is disposed opposite to the arcuate first surface.

In other aspects, the arcuate first surface of each handle housing half-section may define a pair of diametrically opposed legs extending radially outward therefrom.

In aspects, a leg of the pair of opposed legs may define an arcuate first surface and a planar second surface that is disposed opposite thereto.

In certain aspects, the planar second surface of the leg of the pair of legs may define a cavity therein. An inner surface of the cavity defines a longitudinal tab thereon that is configured to be received within a portion of the ratchet pawl such that the ratchet pawl is permitted to translate thereon but not rotate relative thereto.

In other aspects, the inner surface of the cavity may define a protrusion thereon having a relief defined therein. The relief is configured to receive a portion of a ratchet pawl biasing element therein.

In certain aspects, the ratchet pawl biasing element may be interposed between the relief and the ratchet pawl to bias the ratchet pawl into engagement with the plurality of slots of the grip.

According to another aspect of the present disclosure, a method of operating a weight lifting apparatus is provided including grasping a grip of a handle assembly wherein the grip is rotatably supported within a handle housing of the handle assembly, retracting a ratchet pawl from a first position where the grip is inhibited from rotating relative to the handle housing to a second position where the grip is permitted to rotate relative to the handle housing, rotating the grip to a desired radial location relative to the handle housing, and releasing the ratchet pawl from the second position such that the ratchet pawl returns to the first position to inhibit rotation of the grip relative to the handle housing.

In aspects, retracting the ratchet pawl may include retracting the ratchet pawl in a slot defined in the grip of the handle assembly.

In other aspects, retracting the ratchet pawl may include retracting the ratchet pawl in a cavity defined in the handle housing of the handle assembly.

BRIEF DESCRIPTION OF THE DRAWINGS

Various aspects and features of the present disclosure are described hereinbelow with references to the drawings, wherein.

DETAILED DESCRIPTION

Figure 1:
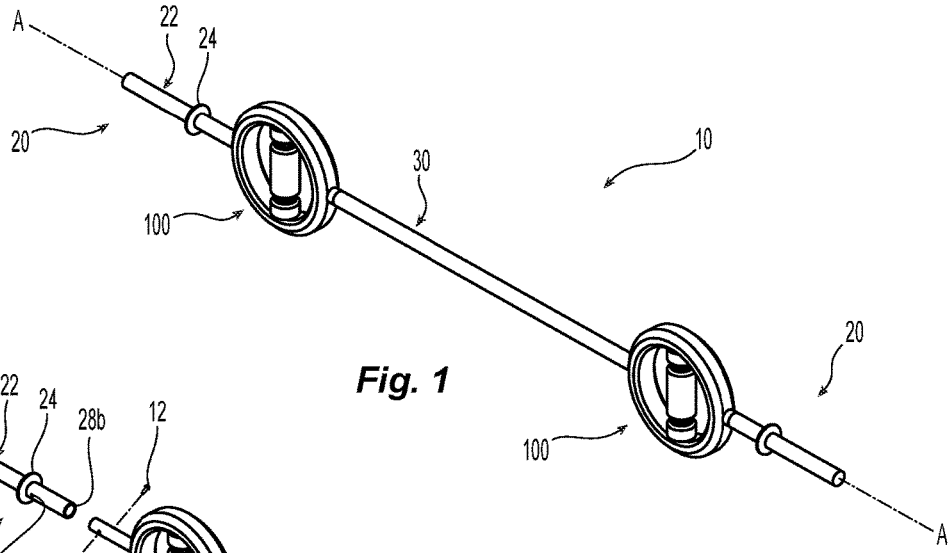
FIG. 1 is a perspective view of a weight lifting device provided in accordance with the present disclosure.

One aspect of the present disclosure is directed to a weight lifting apparatus having adjustable hand grips for use in weight training. The weight lifting apparatus enables a user to grasp the apparatus at various angles relative to a longitudinal axis. Typically, the angle at which the user grasps a weight lifting apparatus is fixed relative to the longitudinal axis. This reduces the ability of a user to use the apparatus to train different muscle groups and increasing the strain placed upon critical ligaments and tendons during use. As will be appreciated, a weight lifting apparatus employing a grip that is selectively rotatable relative to the longitudinal axis expands the number of muscle groups the apparatus may be used to target and reduces the strain placed upon critical ligaments and tendons.

The weight lifting apparatus includes a pair of opposed weight supports, a pair of handle assemblies coupled to the pair of opposed weight supports, and a central bar interposed between each handle assembly of the pair of handle assemblies and coupled thereto. As can be appreciated, the pair of opposed weight supports are configured to support a suitable weight plate or other similar device and receive a barb-bell clamp or the like to retain the weight plates on the weight support. In this manner the weight support includes a radially extending flange capable of inhibiting the weight plates from translating further towards the user's hands. Each handle assembly is coupled to a respective weight support.

The central bar is interposed between the pair of handle assemblies and couples each handle assembly thereto. As can be appreciated, once each of the weight supports, handle assemblies, and central bar are coupled to one another, each is collinear with one another and forms a bar-bell type device.

The handle assemblies include a handle housing, a grip assembly, a ratchet pawl, and a ratchet pawl biasing element. Each of the handle housing and the grip assemblies include a pair of half-sections, that when coupled together, form the respective handle housing and grip assembly. The grip assembly is configured to be rotatably supported within a cavity defined within the handle housing. In one embodiment, the cavity of the handle housing defines a plurality of bosses which is arranged circumferentially thereabout. Each boss is spaced apart from one another forming a plurality of channels in which the ratchet pawl. The ratchet pawl is disposed within a slot defined in a half-section of the grip assembly and enables the ratchet pawl to translate therein. The ratchet pawl biasing element is interposed between the ratchet pawl and a surface of the slot of the grip half-housing to bias the ratchet pawl into engagement with a channel of the plurality of channels of the handle housing. In this manner, to adjust the radial location of the grip relative to the handle housing, a user retracts the ratchet pawl to compress the ratchet pawl biasing element and disengage the ratchet pawl from a channel of the housing assembly. The user may then rotate the grip assembly to the desired radial location and release the ratchet pawl such that the ratchet pawl biasing element biases the ratchet pawl into engagement with another channel of the plurality of channels to lock the grip relative to the handle housing.

In another embodiment, the grip assembly defines a plurality of slots on an outer circumference thereof that are configured to receive a portion of the ratchet pawl therein. The ratchet pawl is slidably disposed within a leg of the handle housing and the ratchet pawl biasing element is interposed between the ratchet pawl and a portion of the leg of the handle housing. In this manner, the ratchet pawl biasing element biases the ratchet pawl into engagement with a slot of the plurality of slots of the grip. To adjust the radial location of the grip relative to the handle housing, the user retracts the ratchet pawl to compress the ratchet pawl biasing element and disengage the ratchet pawl from a slot of the grip. The user may then rotate the grip relative to the handle housing to the desired radial location and release the ratchet pawl such that the ratchet pawl biasing element biases the ratchet pawl into engagement with another slot of the plurality of slots of the grip to lock the grip relative to the handle housing. These and further aspects of the present disclosure are detailed herein below.

With reference to FIGS. 1-15, a weight lifting apparatus provided in accordance with the present disclosure is illustrated and generally identified by reference numeral 10. Although generally illustrated as being a bar-bell, it is contemplated that the weight lifting apparatus 10 may be any suitable weight lifting apparatus having multiple grips, and in embodiments, may be a dumbbell or other similar weight lifting apparatus. The weight lifting apparatus 10 includes a pair of opposed weight supports 20, a central bar 30, and a pair of handle assemblies 100 interposed between each weight support of the opposed weight supports 20 and the central bar 30. When coupled together, the pair of opposed weight supports 20, the pair of handle assemblies 30, and the central bar 40 are disposed collinear relative to one another defining a longitudinal axis A-A.

Figure 3:
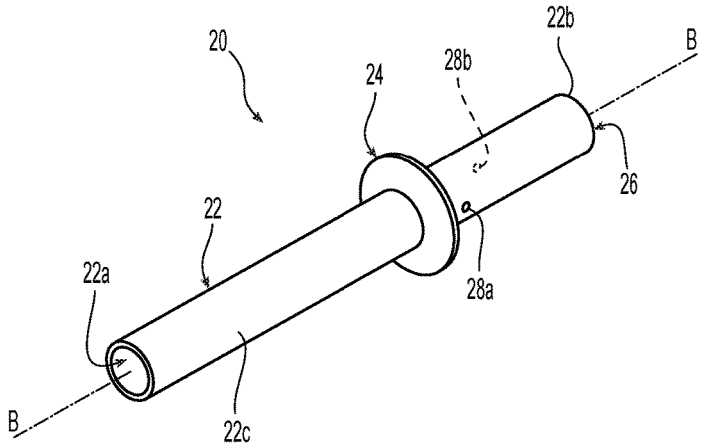
FIG. 3 is a perspective view of a weight support of the weight lifting device of FIG. 1.
Figure 4:
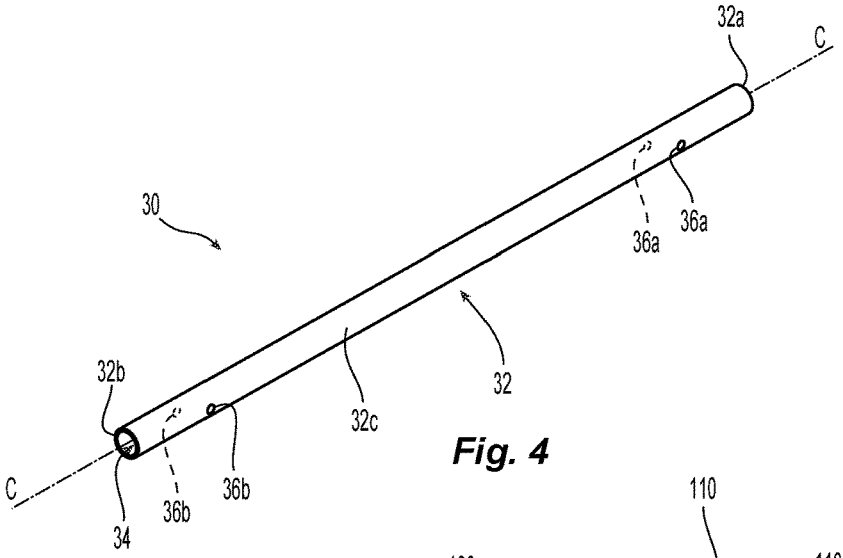
FIG. 4 is a perspective view of a center bar of the weight lifting device of FIG. 1.

Each weight support of the pair of opposed weight supports 20 is substantially similar to the other, and thus, only one weight support 20 will be described in detail hereinbelow in the interest of brevity. The weight support 20 includes an elongated body 22 extending between opposed first and second end surfaces 22*a* and 22*b*, defining a longitudinal axis B-B therethrough (FIG. 3). Although generally illustrated as defining a generally cylindrical profile, it is contemplated that the elongated body 22 may include any suitable profile, such as elliptical, oval, hexagonal, or the like. An outer surface 22*c* of the elongated body 22 defines a radially extending flange 24 thereon at a center portion thereof. The radially extending flange 24 may be disposed on the outer surface 22*c* of the elongated body 22 at any suitable location depending on the number of weight lifting plates (not shown) intended to be supported on the weight support 20. The radially extending flange 24 is configured to inhibit further translation of a weight lifting plate (not shown) towards the second end surface 22*b*. It is contemplated that the radially extending flange 24 may be a separate component from the elongated body 22 and may be secured to the outer surface 22*c* of the elongated body 22 using any suitable means, such as adhesives, welding, fasteners, etc. In one non-limiting embodiment, the radially extending flange 24 is integrally formed with the elongated body 22.

The opposed end surfaces 22*a*, 22*b* define a throughbore 26 therethough configured to slidably receive a portion of a handle assembly of the pair of handle assemblies 100 therein, as will be described in further detail hereinbelow. The outer surface 22*c* of the elongated body 22 defines a pair of transverse bores 28*a* and 28*b* therethrough configured to receive a fastener therethrough to couple a handle assembly of the pair of handle assemblies 30 thereto. The pair of transverse bores 28*a*, 28*b* are disposed opposite one another and are longitudinally spaced apart along the longitudinal axis B-B, although it is contemplated that the pair of transverse bores 28*a*, 28*b* may be diametrically opposed to one another.

Figure 2:
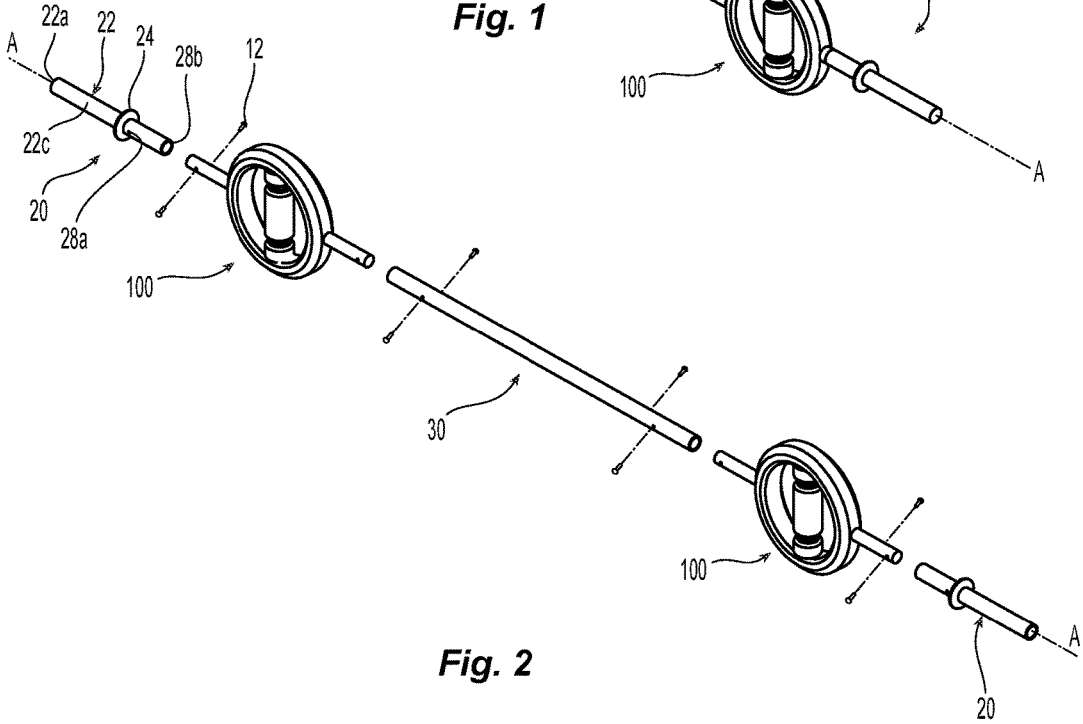
FIG. 2 is a perspective view, with parts separated, of the weight lifting device of FIG. 1.

It is contemplated that the weight support 20 may be formed from any material having suitable stiffness and durability for use in a weight training environment, such as metallic, non-metallic, composite, or the like and may be cast, extruded, machined from billet, etc. As illustrated in FIG. 2, each weight support 20 is coupled to a respective handle assembly 100 using a fastener 12, although it is contemplated that the weight support 20 may be coupled to the handle assembly 100 using any suitable manufacturing methods, such as welding, adhesives, push buttons spring clips, etc.

The center bar 30 includes an elongated body 32 (FIG. 4) extending between first and second end surfaces 32*a* and 32*b*, defining a longitudinal axis C-C. Although generally illustrated as having a cylindrical configuration, it is contemplated that the elongated body 32 may include any suitable configuration, such as elliptical, oval, hexagonal, or the like, and may be the same or different than the configuration of the weight support 20. The first and second end surfaces 32*a*, 32*b* define a bore 34 therethrough configured to slidably receive a portion of a respective handle assembly 100 therein, as will be described in further detail hereinbelow. An outer surface 32*c* of the elongated body 32 defines a first and second pair of apertures 36*a* and 36*b* therethrough configured to receive a respective fastener 12 therein to couple the center bar 30 to each respective handle assembly 100. In this manner, the first pair of apertures 36*a* is defined adjacent the first end surface 32*a* and the second pair of apertures 36*b* is defined adjacent the second end surface 32*b*. Each aperture of the first pair apertures 36*a* is defined opposite one another and longitudinally spaced apart along the longitudinal axis C-C, although it is contemplated that each aperture of the first pair of apertures 36*a* may be diametrically opposed to one another. Similarly, each aperture of the second pair of apertures 36*b* is defined opposite one another and longitudinally spaced apart along the longitudinal axis C-C, although it is contemplated that each aperture of the second pair of apertures 36*b* may be diametrically opposed to one another. In embodiments, the first pair of apertures 36*a* may be diametrically disposed to one another while the second pair of apertures 36*b* may be longitudinally spaced apart, or vice versa. As can be appreciated, the first and second pair of apertures 36*a*, 36*b* may be disposed in any suitable configuration, such as diametrically opposed, longitudinally offset, or combinations thereof.

It is contemplated that the center bar may be formed from any material having suitable stiffness and durability for use in a weight training environment, such as metallic, non-metallic, composite, or the like and may be cast, extruded, machined from billet, etc. Although generally illustrated as being coupled to each handle assembly 100 using the fasteners 12 (FIG. 2), it is contemplated that the center bar 30 may be coupled to each handle assembly 100 using any suitable manufacturing methods, such as welding, adhesives, push button spring clips, etc.

Figure 5:
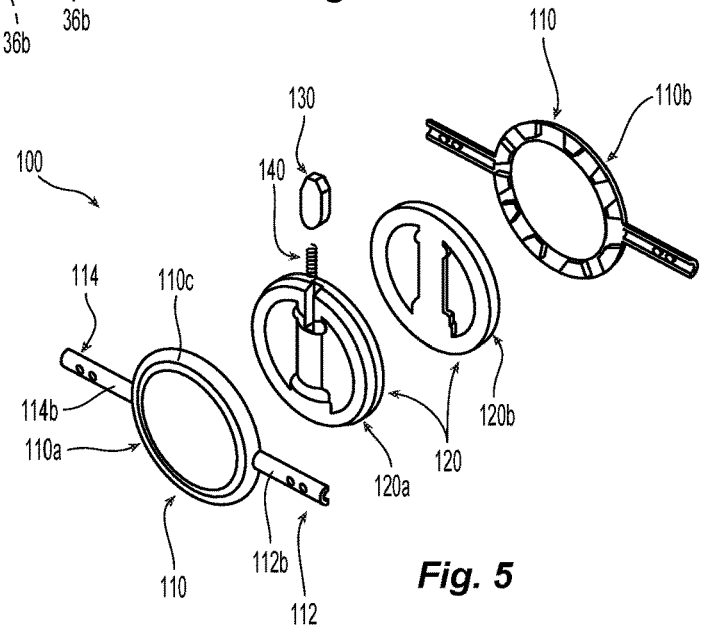
FIG. 5 is a perspective view, with parts separated, of a handle assembly of the weight lifting device of FIG. 1.

With reference to FIG. 5, each handle assembly of the pair of handle assemblies 100 includes a handle housing 110, a grip 120, a ratchet pawl 130, and a ratchet pawl biasing element 140. Each handle assembly of the pair of handle assemblies 100 is substantially similar, and therefore, only one handle assembly of the pair of handle assemblies 100 is described herein in the interest of brevity.

The handle housing 110 defines a generally circular or toroidal configuration including first and second half-sections 110*a* and 110*b*, although any suitable configuration is contemplated, such as hexagonal, octagonal, oval, etc. Each half-section of the first and second half-sections 110*a*, 110*b* are substantially similar, and therefore, only the first half-section 110*a* of the handle housing 110 will be described in detail in the interest of brevity.

Figure 6:
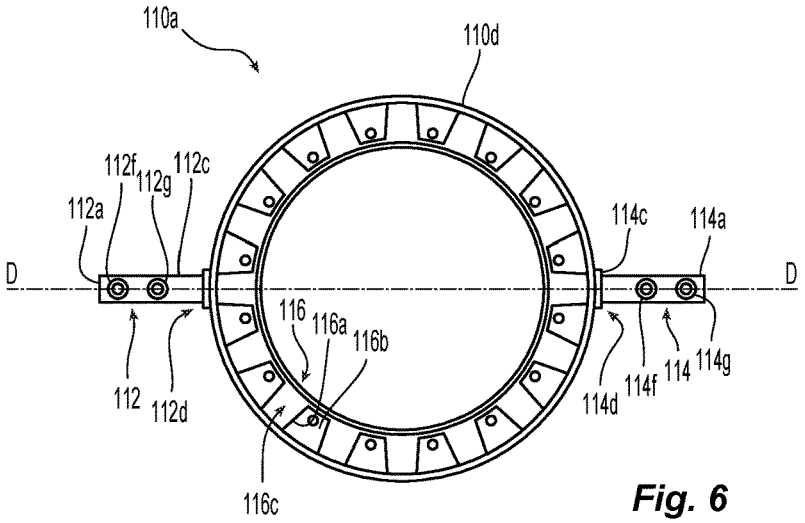
FIG. 6 is a rear view of a handle housing of the handle assembly of FIG. 5.
Figure 7:
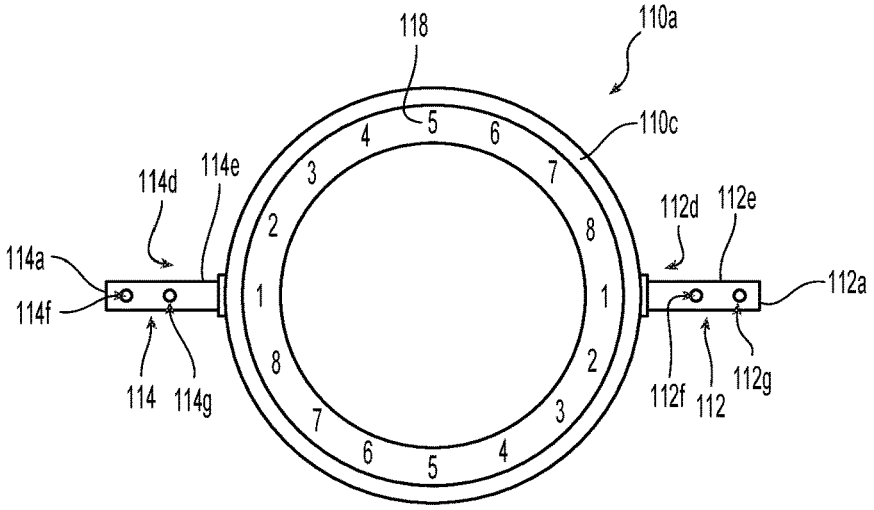
FIG. 7 is a front view of the handle housing of FIG. 6.

The first half-section 110*a* defines a generally hemitoroidal or doughnut configuration having an arcuate surface 110*c* and a planar surface 110*d* (FIG. 6) disposed opposite thereto. The arcuate surface 110*c* defines a pair of diametrically opposed legs 112 and 114 extending radially outward therefrom and terminating at respective end surfaces 112*a* and 114*a*, defining a longitudinal axis D-D therethrough. Each leg of the pair of opposed legs 112, 114 defines a generally hemicylindrical profile having an arcuate surface 112*b*, 114*b* (FIG. 7) and an opposite planar surface 112*c*, 114*c* (FIG. 6). As illustrated in FIGS. 6 and 7, the arcuate surfaces 112*b*, 114*b* are configured to be flush with the arcuate surface 110*c* of the first half-section 110*a* and the planar surfaces 112*c*, 114*c* are configured to be co-planar with the planar surface 110*d* of the first half-section 110*a*. Each end surface 112*a*, 114*a* defines a respective relief 112*d* and 114*d* extending radially inward therefrom and extending longitudinally inward (e.g., toward the arcuate surface 110*c* of the first half-section 110). An outer surface 112*e* and 114*e* of each respective leg 112, 114 defines a threaded bore 112*f* and 114*f*, respectively, and a through-bore 112*g* and 114*g*, respectively. The threaded bore 112*f* of the leg 112 is disposed radially inward (e.g., closer to the center of the first half-section 110*a*) from the through-bore 112*g* and the threaded bore 114*f* of the leg 114 is disposed radially outward (e.g., further from the center of the first half-section 110*a*) from the through-bore 114*g*, although other configurations are also contemplated. As can be appreciated, the mirrored configuration of the threaded bore 112*f* and through-bore 112*g* of the leg 112 relative to the threaded bore 114*f* and through-bore 114*g* of the leg 114 enables each half-section 110*a*, 110*b* of the handle housing 110 to be identical. In this manner, when the planar surfaces 110*d* of two first half-sections 110*a* are placed adjacent one another (e.g., in a mirrored fashion), a through-bore 114*g* of either of the two first half-sections 110*a* is aligned with a threaded bore 114*f* of either of the two first half-sections 110*a*. In embodiments, it is contemplated that the first and second half-sections 110*a*, 110*b* may differ from one another.

The planar surface 110*d* of the first half-section 110*a* defines a counterbore 116 therein defining an inner surface 116*a* (FIG. 6). The inner surface 116*a* of the counterbore 116 defines a plurality of circumferentially arranged bosses 116*b* thereon. Each boss of the plurality of bosses 116*b* includes a generally trapezoidal profile having a shorter base thereof disposed radially inward of the longer base thereof. The plurality of bosses are disposed 22.5 degrees from one another about the circumference of the inner surface 116*a*, such that the plurality of bosses 116*b* includes sixteen bosses. A respective pair of bosses of the plurality of bosses 116*b* defines a channel 116*c* therebetween configured to selectively receive a portion of the ratchet pawl 130 therein, as will be described in further detail herein. As can be appreciated, the number of bosses of the pair of bosses 116*b* defines the number of radial locations at which the ratchet pawl 130, and therefore the grip 120, may be oriented. In embodiments, the plurality of bosses 116*b* may include any suitable number of bosses disposed at corresponding equal or non-equal angles depending upon the number of radial positions at which the grip 120 is intended to be placed.

The arcuate surface 110*c* of the first half section 110*a* includes a plurality of indicators 118 thereon (FIG. 7) arranged in a circumferential fashion thereabout. Although generally shown as being numeric indicators, it is contemplated that the plurality of indicators 118 may be any suitable indicator capable of indicating to the user that the grip 130 is placed in a specific orientation relative to the first half-section 110*a*, such as letters, roman numerals, etc. In one non-limiting embodiment, the plurality of indicators 118 includes two sequences of the numbers "1," "2," "3," "4," "5," "6," "7," and "8." Each sequence includes the number "1" placed adjacent a respective leg of the opposed legs 112, 114, although it is contemplated that each sequence may begin at any radial location on the arcuate surface 110*c*. As can be appreciated, the number of indicators included in each sequences depends on the number of bosses included in the plurality of bosses 116*b*.

It is contemplated that the first and second half-sections 110*a*, 110*b* of the handle housing 110 may be formed from any material having suitable stiffness and durability for use in a weight training environment, such as metallic, non-metallic, composite, etc. and may be cast, extruded, machined, etc. In one non-limiting embodiment, the first and second half-sections 110*a*, 110*b* are formed from a cast metallic material.

Figure 8:
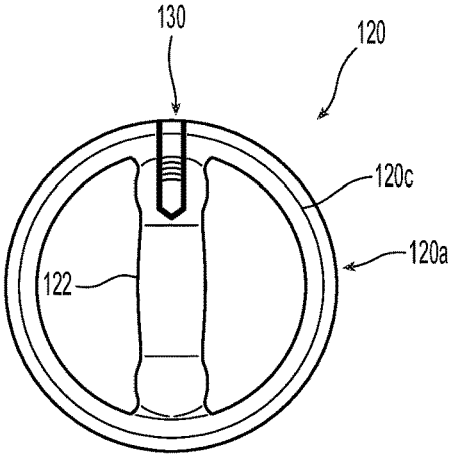
FIG. 8 is a front view of a grip assembly of the handle assembly of FIG. 5.

With reference to FIGS. 5 and 8, the grip 120 includes first and second half-sections 120*a* and 120*b*, each defining a generally hemitoroidal configuration such that the first and second half-sections 120*a*, 120*b* form a toroid when placed adjacent one another (e.g., in a mirrored fashion). Each half-section of the first and second half-sections 120*a*, 120*b* are substantially similar to one another, and therefore, only the first half-section 120*a* will be described in detail herein in the interest of brevity.

Figure 9:
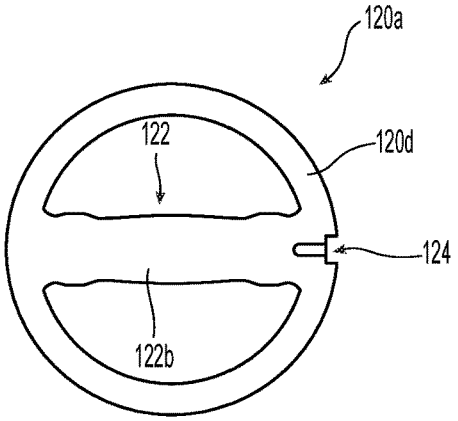
FIG. 9 is a rear view of a grip housing half-section of the grip assembly of FIG. 8.
Figure 10:
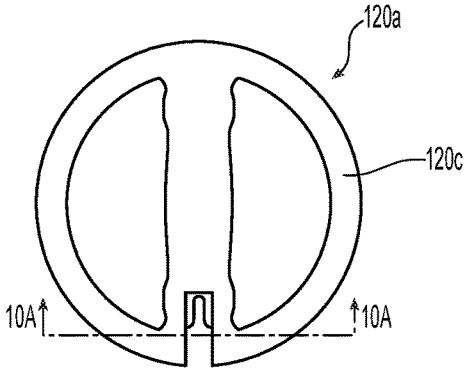
FIG. 10 is a front view of the grip housing half-section of FIG. 9.
Figure 10A:
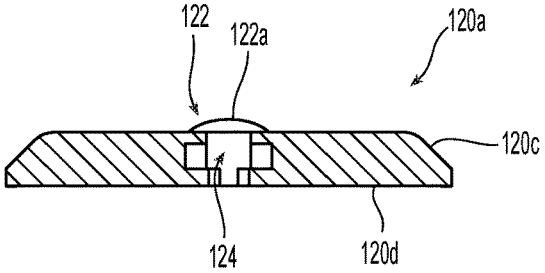
FIG. 10A is a cross-sectional view of the grip housing half-section of FIG. 10, taken along section line 10A-10A of FIG. 10.
Figure 11:
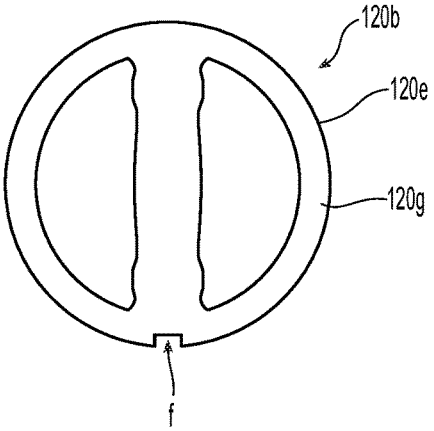
FIG. 11 is a front view of an opposite grip housing half-section of the grip assembly of FIG. 6.
Figure 12:
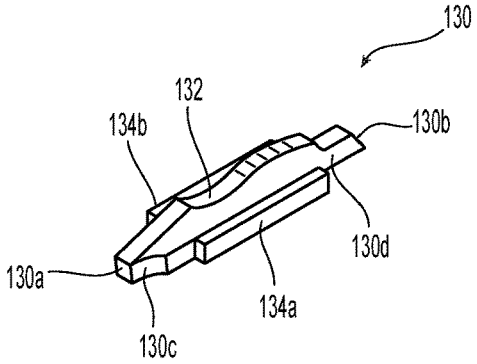
FIG. 12 is a perspective view of a ratchet pawl of the grip assembly of FIG. 8.
Figure 13:
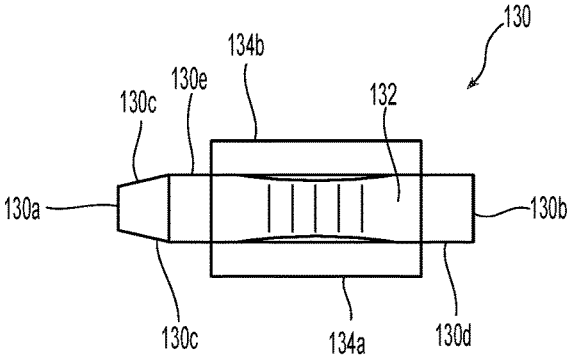
FIG. 13 is a top view of the ratchet pawl of FIG. 12.
Figure 14:
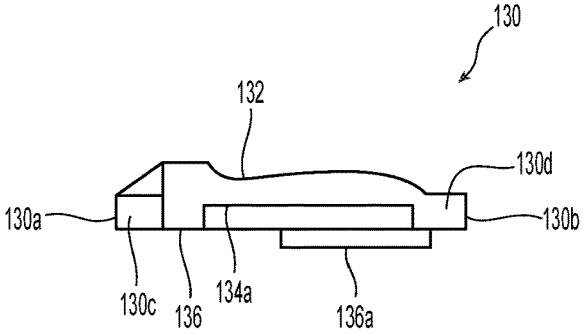
FIG. 14 is a side view of the ratchet pawl of FIG. 12.
Figure 15:
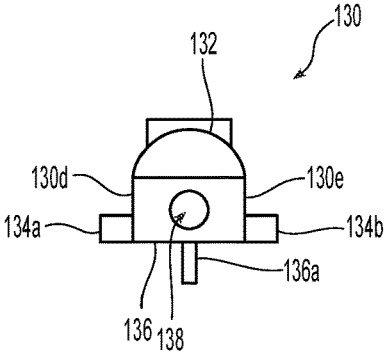
FIG. 15 is a rear view of the ratchet pawl of FIG. 12.

The first half-section 120*a* defines an arcuate first surface 120*c* and a planar second surface 120*d* disposed opposite to the arcuate first surface 120*c*. Although generally illustrated as having an arcuate first surface, it is contemplated that the first half-sections 120*a* may define any suitable configuration capable of being rotatably retained within the first and second half-sections 110*a*, 110*b* of the housing assembly 110, as will be described in further detail hereinbelow. The first half-section 120*a* includes a grip member 122 extending between diametrically opposed points defined on an interior diameter of the first half-section 120*a*. The grip member 122 includes a generally contoured upper surface 122*a* (FIG. 10A) and a planar bottom surface 122*b* (FIG. 9). As can be appreciated, the contoured upper surface 122*a* is configured to be grasped by the user, and therefore, may include any suitable profile capable of providing a comfortable grip and enabling the user to securely grasp the grip 120. The arcuate first surface 120*c* defines a slot 124 (FIGS. 10 and 10A) therein extending into the grip member 122. The slot 124 is configured to slidably receive the ratchet pawl 130 therein and ensure that the ratchet pawl 130 is permitted to translate in a longitudinal direction defined by the grip member 122. The slot 124 is configured to retain the ratchet pawl biasing element 140 therein such that the ratchet pawl biasing element 140 is interposed between an end wall (not shown) defined by the slot 124 and a second surface 130*b* (FIG. 14) of the ratchet pawl 130 such that the ratchet pawl 130 is biased in a radially outward direction and into engagement with a respective channel 116*c* of the first and second half-sections 110*a*, 110*b* of the handle housing 110, as will be described in further detail hereinbelow. In embodiments, the arcuate first surface 120*c* of the first half-section 120*a* may include an indicator thereon capable of indicating to the user which hand is intended to be used therewith. In one non-limiting embodiment, the indicator is the letter "R" to indicate use with the user's right hand, and the indicator "L" to indicate use with the user's left hand. As can be appreciated, any suitable indicator may be used that is capable of indicating to the user which hand to use with the respective grip, and in embodiments, no indicator may be utilized.

Although substantially similar to the first half-section 120*a*, the second half-section 120*b* of the grip assembly 120 does not include a slot 124 formed therein. Rather, a planar second surface 120*e* defines a channel 120*f* therein adjacent the circumference of the second half-section 120*b* and extending through an arcuate first surface 120*g*.

It is contemplated that the first and second half sections 120*a*, 120*b* of the grip assembly 120 may be formed from any material having suitable stiffness and durability for use in a weight training environment, such as metallic, non-metallic, composite, or the like and may be cast, injection molded, machined, etc. In one non-limiting embodiment, the first and second half-sections 120*a*, 120*b* are formed from an injection molded non-metallic material.

Turning now to FIGS. 12-15, the ratchet pawl 130 defines an elongated body extending between first and second end surfaces 130*a* and 130*b*. The first end surface 130 defines a generally blunt or planar configuration transitioning to a generally trapezoidal configuration in a direction towards the second end surface 130*b* when viewed in a plan view. The trapezoidal configuration of the ratchet pawl 130 is configured to be selectively received within a respective channel 116*c* (FIG. 6) of the first and second half-sections 110*a*, 110*b* of the handle housing 110. In this manner, tapered side surfaces 130*c* of the ratchet pawl 130 abut portions of respective bosses of the plurality of bosses 116*b* that defines the channels 116*c* of the first and second half-sections 110*a*, 110*b* of the handle housing 110 to inhibit rotation of the grip 120 relative to the handle housing 110.

An upper surface 132 of the elongated body defines a generally contoured profile configured to engage a user's finger, such as a thumb, such that the user can manipulate or translate the ratchet pawl 130 within the slot 124 (FIGS. 10 and 10A) of the first half-section 120*a* of the grip 120. In embodiments, the upper surface 132 may include crenellations, grooves, or any other suitable means to provide additional grip. The elongated body of the ratchet pawl 130 defines opposed side surfaces 130*d* and 130*e* extending between the first and second end surfaces 130*a*, 130*b*. Each side surface 130*d* and 130*e* defines a wing 134*a* and 134*b* disposed opposite to one another configured to be received within the slot 124 of the first half-section 120*a* of the grip 120. The wings 134*a*, 134*b* inhibit the ratchet pawl 130 from rotating in any direction within the slot 124, such that the ratchet pawl 130 may only translate in a longitudinal direction within the slot 124.

The elongated body of the ratchet pawl 130 defines a lower surface 136 (FIG. 14) opposite the upper surface 132 and extending between the first and second end surfaces 130*a*, 130*b*. The lower surface 136 defines a tab or fin 136*a* extending therefrom configured to be slidably received within the slot 124 of the of the first half-section 120*a* of the grip 120. The tab 136*a* provides increased stability and resistance against rotation during translation of the ratchet pawl 130.

The second end surface 130*b* defines a counterbore 138 (FIG. 15) therein configured to receive a portion of the ratchet pawl biasing element 140 (FIG. 5) to locate the ratchet pawl biasing element 140 and provide increased stability thereto as the ratchet pawl biasing element 140 is compressed and/or elongated. It is contemplated that the second end surface 130*b* may include any feature capable of capturing or locating the ratchet pawl biasing element 140, and in embodiments, the second end surface 130*b* may be planar and not include a counterbore 138.

It is contemplated that the ratchet pawl 130 may be formed from any material having suitable stiffness and durability for use in a weight training environment, such as metallic, non-metallic, composite, or the like and may be cast, injection molded, machined, etc. In one non-limiting embodiment, the ratchet pawl 130 is formed from an injection molded non-metallic material.

With reference to FIGS. 2 and 16A-16C, in operation, the user places the desired weight plates or barbell plates (not shown) over the outer surface 22*c* of the weight support 20 until the interior most weight plate abuts the radially extending flange 24. Once the desired number of weight plates are placed on the weight support 20, a barbell clamp (not shown) or other suitable device capable of retaining the weight plates on the weight support 20 is placed over outer surface 22*c* of the weight support 20 and secured thereto to retain the weight plates on the weight support 20. This process is repeated for the remaining weight support 20 until the desired weight is supported on the weight supports 20.

Figure 16A:
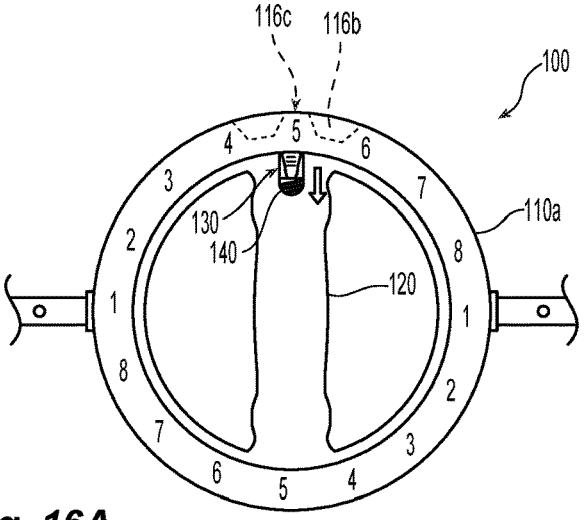
FIG. 16A is a front view of the handle assembly of FIG. 5 shown with the ratchet pawl of FIG. 12 in an initial state.
Figure 16B:
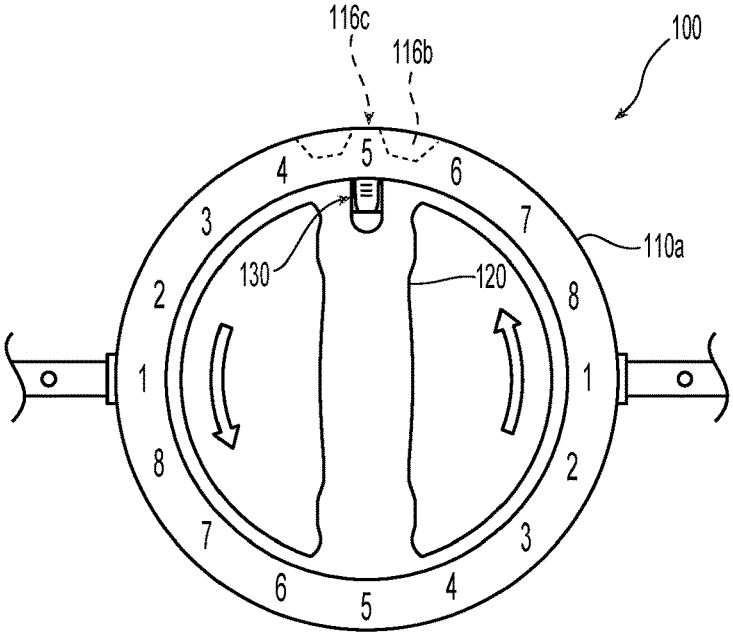
FIG. 16B is a front view of the handle assembly of FIG. 5 shown with the ratchet pawl of FIG. 12 in a retracted state.
Figure 16C:
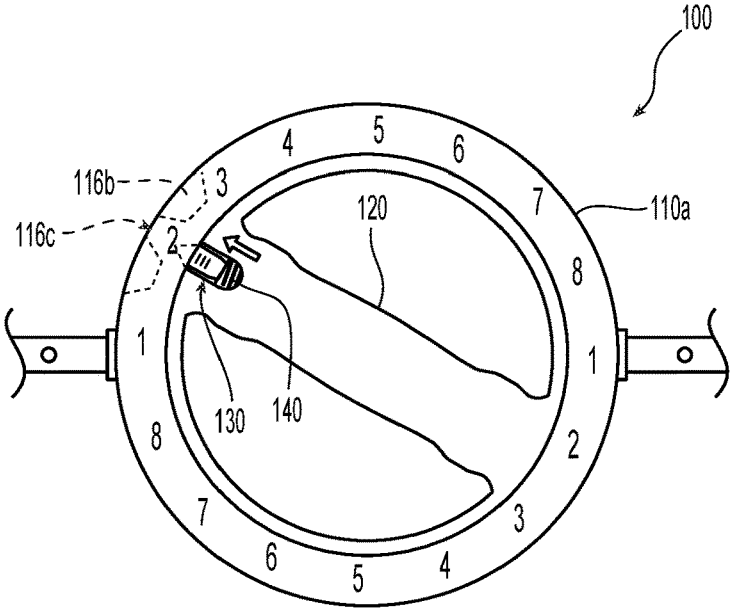
FIG. 16C is a front view of the handle assembly of FIG. 5 shown with the grip assembly of FIG. 8 rotated from its initial state.
Figure 17:
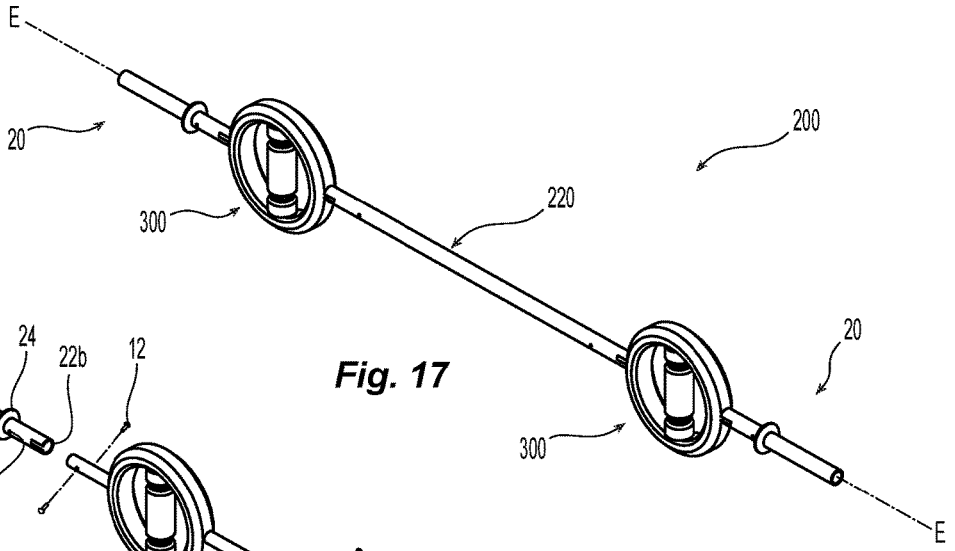
FIG. 17 is a perspective view of another embodiment of a weight lifting device provided in accordance with the present disclosure.
Figure 18:
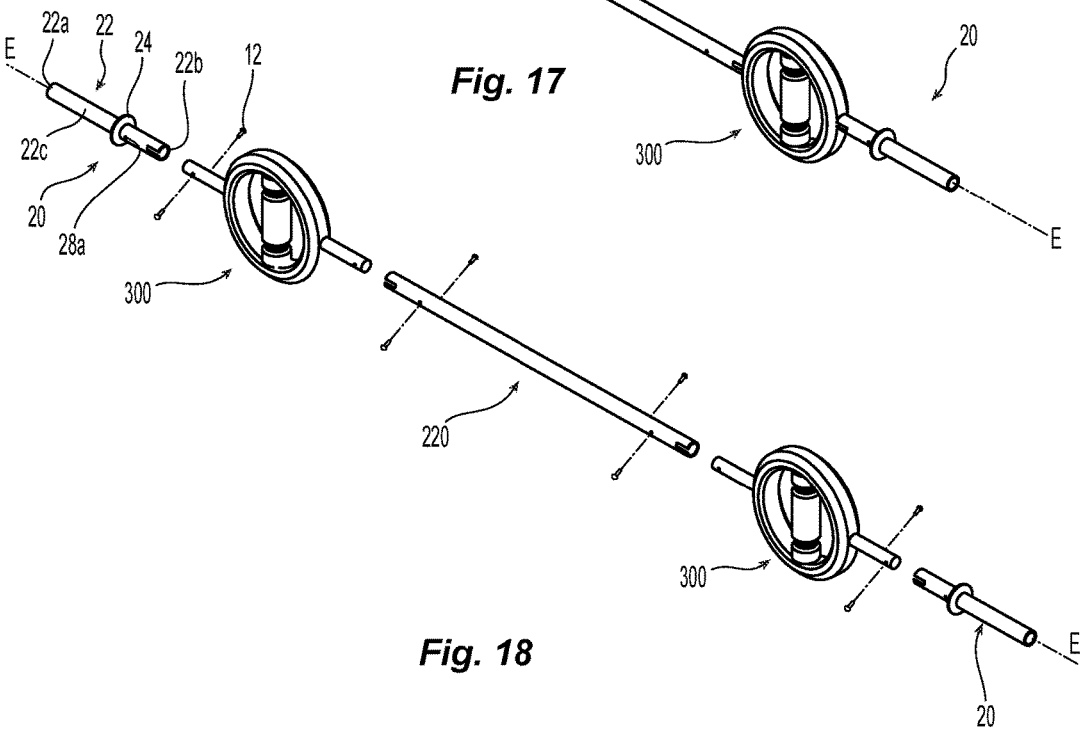
FIG. 18 is a perspective view, with parts separated, of the weight lifting device of FIG. 17.
Figure 19:
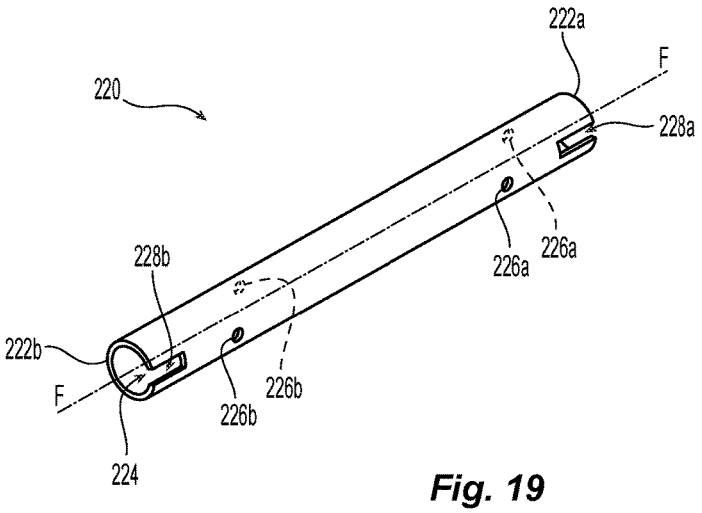
FIG. 19 is a perspective view of a center bar of the weight lifting device of FIG. 17.

At this point, the user grasps one or both grips 120 of the handle assemblies 100. The user uses a finger, such as a thumb, to retract each ratchet pawl 130 of each respective handle assembly 100. In this manner, the user pulls the ratchet pawl 130 radially inward (FIG. 16A) to compress the ratchet pawl biasing element 140 and disengage the ratchet pawl 130 from a channel 116*c* of the respective handle housing 110. Once the ratchet pawl 130 is retracted, the user may rotate the grip 120 relative to the handle housing 110 (FIG. 16B) to place the grip in the desired position (e.g., position "1," "2," "3," "4," "5," "6," "7," or "8") (FIG. 16C). As can be appreciated, the user may place each grip 120 in a different position relative to one another, (e.g., the right grip 120 may be placed in position "1" whereas the left grip 120 may be placed in position "4") depending upon which muscles the user intends to target. This process may be repeated as many times as desired by the user.

Turning now to FIGS. 17-30, another embodiment of a weight lifting apparatus is provided and generally identified by reference numeral 200. Although generally illustrated as being a barbell, it is contemplated that the weight lifting apparatus 200 may be any suitable weight lifting apparatus having multiple grips, and in embodiments, may be a dumbbell or other similar weight lifting apparatus. The weight lifting apparatus 200 includes a pair of opposed weight supports 20, a central bar 220, and a pair of handle assemblies 300 interposed between each weight support of the opposed weight supports 20 and the central bar 220. When coupled together, the pair of opposed weight supports 20, the pair of handle assemblies 300, and the central bar 220 are disposed collinear relative to one another defining a longitudinal axis E-E.

The weight supports 20 of the weight lifting apparatus 200 are substantially similar to the weight supports 20 of the weight lifting apparatus 10 described hereinabove, and therefore, will not be described in detail hereinbelow in the interest of brevity.

The central bar 220 includes an elongated body 222 (FIG. 19) extending between first and second end surfaces 222*a* and 222*b*, defining a longitudinal axis F-F. Although generally illustrated as having a cylindrical configuration, it is contemplated that the elongated body 222 may include any suitable configuration, such as elliptical, oval, hexagonal, etc., and may be the same or different than the configuration of the weight support 210. The first and second end surfaces 222*a*, 222*b* define a bore 224 therethrough configured to slidably receive a portion of a respective handle assembly 300 therein, as will be described in further detail hereinbelow. An outer surface 222*c* of the elongated body 222 defines a first and second pair of apertures 226*a* and 226*b* therethrough that are configured to receive a respective fastener 202 therein to couple the center bar 220 to each respective handle assembly 300. In this manner, the first pair of apertures 226*a* is defined adjacent the first end surface 222*a* and the second pair of apertures 226*b* is defined adjacent the second end surface 222*b*. Each aperture of the first pair of apertures 226*a* is defined opposite one another and longitudinally spaced apart along the longitudinal axis F-F, although it is contemplated that each aperture of the first pair of apertures 226*a* may be diametrically disposed relative to one another. Similarly, each aperture of the second pair of apertures 226*b* is defined opposite one another and longitudinally spaced apart along the longitudinal axis F-F, although it is contemplated that each aperture of the second pair of apertures 226*b* may be diametrically opposed to one another. In embodiments, the first pair of apertures 226*a* may be diametrically disposed relative to one another while the second pair of apertures 226*b* may be longitudinally spaced apart, or vice versa. As can be appreciated, the first and second pair of apertures 226*a*, 226*b* may be disposed in any suitable configuration, such as diametrically disposed, longitudinally offset, or combinations thereof.

The outer surface 222*c* defines a pair of channels 228*a* and 228*b* disposed adjacent respective first and second end surfaces 222*a*, 222*b*. The pair of channels 228*a*, 228*b* extend through respective first and second end surfaces 222*a*, 222*b* and extend radially inward into the bore 224. The pair of channels 228*a*, 228*b* are configured to receive a portion of a ratchet pawl of the handle assemblies 300 when the center bar 220 is secured to each handle assembly 300, as will be described in further detail hereinbelow.

It is contemplated that the center bar may be formed from any material having suitable stiffness and durability for use in a weight training environment, such as metallic, non-metallic, composite, or the like and may be cast, extruded, machined from billet, etc. Although generally illustrated as being coupled to each handle assembly 300 using the fasteners 12 (FIG. 18), it is contemplated that the center bar 220 may be coupled to each handle assembly 300 using any suitable means, such as welding, adhesives, push button spring clips, etc.

Figure 20:
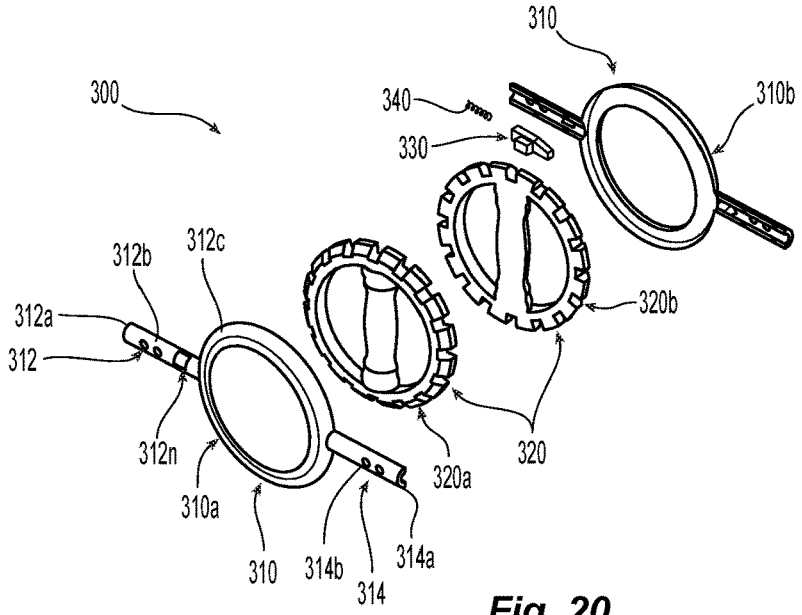
FIG. 20 is a perspective view, with parts separated, of a handle assembly of the weight lifting device of FIG. 17.

With reference to FIG. 20, each handle assembly of the pair of handle assemblies 300 includes a handle housing 310, a grip 320, a ratchet pawl 330, and a ratchet pawl biasing element 340. Each handle assembly of the pair of handle assemblies 300 is substantially similar, and therefore, only one handle assembly of the pair of handle assemblies 300 will be described herein in the interest of brevity.

Figure 21:
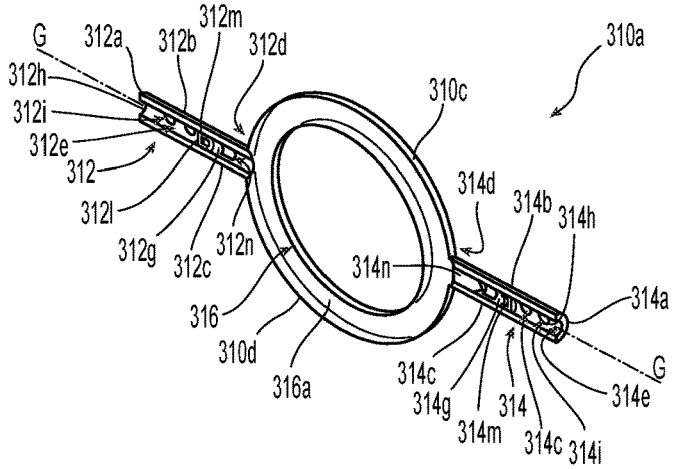
FIG. 21 is a perspective view of a handle housing of the weight lifting device of FIG. 17.

The handle housing 310 includes two half-sections 310*a* and 310*b*, each being substantially similar, and therefore, only half-section 310*a* will be described in detail in the interest of brevity. The half section 310*a* defines a generally hemitoroidal or doughnut configuration having an arcuate surface 310*c* (FIG. 20) and a planar surface 310*d* (FIG. 21) disposed opposite thereto. The arcuate surface 310*c* defines a pair of diametrically opposed legs 312 and 314 extending radially outward therefrom and terminating at respective end surfaces 312*a* and 314*a*, defining a longitudinal axis G-G therethrough. Each leg of the pair of opposed legs 312, 314 defines a generally hemicylindrical profile having an arcuate surface 312*b* and 314*b* (FIG. 20) and an opposite planar surface 312*c* and 314*c* (FIG. 21). As illustrated in FIGS. 20 and 21, the arcuate surfaces 312*b*, 314*b* are configured to be flush with the arcuate surface 310*c* of the first half-section 310*a* and the planar surfaces 312*c*, 314*c* are configured to be co-planar with the planar surface 310*d* of the first half-section 310*a*. Each end surface 312*a*, 314*a* defines a respective relief 312*d* and 314*d* extending radially inward therefrom and extending longitudinally inward (e.g., toward the arcuate surface 310*c* of the first half-section 310).

Figure 22:
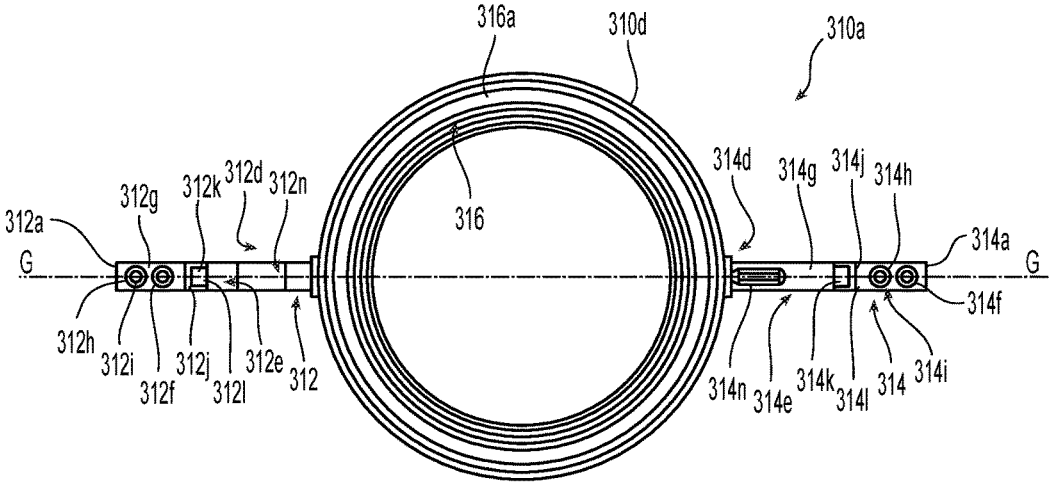
FIG. 22 is a rear view of the handle housing of FIG. 21.

The planar surface 310*d* of the half-section 310*a* defines a counterbore 316 therein defining an inner surface 316*a* (FIGS. 21 and 22). The inner surface 316*a* acts as a bearing surface against the grip 320 such that the grip 320 is rotatably secured within the counterbores 316 of the half-sections 310*a* when in an assembled state. The planar surfaces 312*c*, 314*c* each define a cavity 312*e* and 314*e* therein, respectively, extending through each respective end surfaces 312*a*, 314*a* at a first end and into the counterbore 316. Each arcuate surface 312*b*, 314*b* define a throughbore 312*f* and 314*f* (FIG. 22) therethrough and extending through an inner surface 312*g* and 314*g* of each of the cavities 312*e* and 314*e*, respectively. The inner surfaces 312*g*, 314*g* of the cavities 312*e*, 314*e* define a respective boss 312*h* and 314*h* extending therefrom, each boss 312*h*, 314*h* having a threaded blind hole 312*i* and 314*i* defined therein, respectively. As illustrated in FIG. 22, the boss 312*h* of the leg 312 is disposed radially outward (e.g., further to the center of the half-section 310*a*) from the through-bore 312*f* and the boss 314*h* of the leg 314 is disposed radially inward (e.g., closer from the center of the half-section 310*a*) from the through-bore 314*f*, although other configurations are also contemplated. As can be appreciated, the mirrored configuration of the throughbore 312*f* and the boss 312*h* of the leg 312 relative to the throughbore 314*f* and the boss 314*h* of the leg 314 enables each half-section 310*a* of the handle housing 310 to be identical. In this manner, when the planar surfaces 310*d* of each half-section 310*a* of the handle housing 310 are placed adjacent one another and rotated 180 degrees relative to one another (e.g., a mirrored fashion), the throughbores 312*f*, 314*f* are aligned with the threaded blind holes 312*i*, 314*i* of a respective half-section 310*a*.

The inner surface 312*g* of the leg 312 defines a protrusion 312*j* radially inward of the boss 312*h* and having a generally square profile, although any suitable profile is contemplated. A relief 312*k* is defined through an upper surface 312L and a side surface 312*m* disposed at a radially inner portion of the protrusion 312*j*. The relief 312*k* is configured to receive the ratchet pawl biasing element 340 therein. The inner surface 314*g* of the leg 314 defines a protrusion 314*j* radially inward of the throughbore 314*f* and is substantially similar to the protrusion 312*j*, and therefore will not be described in further detail in the interest of brevity. The protrusions 312*j*, 314*j* are disposed on the inner surfaces 312*g*, 314*g* of the legs 312, 314 such that when the planar surfaces 310*d* of each half-section 310*a* of the handle housing 310 are placed adjacent one another and rotated 180 degrees relative to one another (e.g., a mirrored fashion), the reliefs 312*k* and 314*k* of the respective protrusions 312*j*, 314*j* are aligned with one another to capture the ratchet pawl biasing element 340 therein.

The inner surface 314*g* defines a longitudinal tab 314*n* (FIGS. 21 and 22) thereon that extends in a direction disposed parallel to the longitudinal axis G-G. The longitudinal tab 314*n* is disposed radially inward of the protrusion 314*j* and is configured to be received within a portion of the ratchet pawl 330 to provide stability and inhibit rotation of the ratchet pawl 330, as will be described in further detail hereinbelow. The inner surface 312*g* of the leg 312 defines a window 312*n* (FIGS. 21 and 22) therethrough and extending through the arcuate surface 312*b*. The window 312*n* is disposed radially inward of the protrusion 312*j* and is configured to receive a portion of the ratchet pawl 330 therethrough to enable a user to manipulate the ratchet pawl 330, as will be described in further detail hereinbelow.

The arcuate surface 310*c* of the first half-section 310*a* includes a plurality of indicators 318 thereon (FIGS. 20 and 31) arranged in a circumferential fashion thereabout. Although generally shown as being numeric indicators, it is contemplated that the plurality of indicators 118 may be any suitable indicator capable of indicating to the user that the grip 330 is placed in a specific orientation relative to the first half-section 310*a*, such as letters, roman numerals, etc. In one non-limiting embodiment, the plurality of indicators 118 includes two sequences of the numbers "1," "2," "3," "4," "5," "6," "7," and "8." Each sequence includes the number "1" placed adjacent a respective leg of the opposed legs 312, 314, although it is contemplated that each sequence may begin at any radial location on the arcuate surface 310*c*. As can be appreciated, the number of indicators included in each sequence depends on the number of slots 324 included in the plurality of slots 324 of the grip 320 (FIGS. 23-25).

It is contemplated that the first and second half-sections 310*a*, 310*b* of the handle housing 310 may be formed from any material having suitable stiffness and durability for use in a weight training environment, such as metallic, non-metallic, composite, etc. and may be cast, extruded, machined, etc. In one non-limiting embodiment, the first and second half-sections 310*a*, 310*b* are formed from a cast metallic material.

Figure 23:
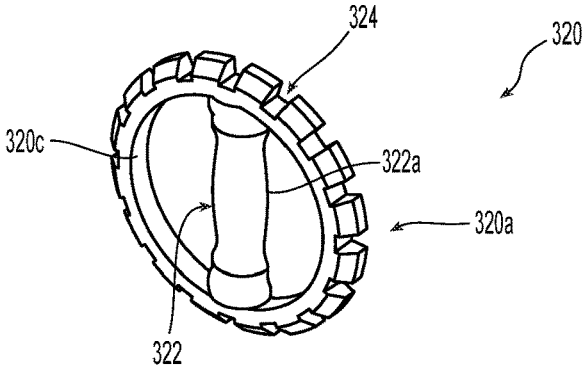
FIG. 23 is a perspective view of a grip of the handle assembly of FIG. 21.
Figure 24:
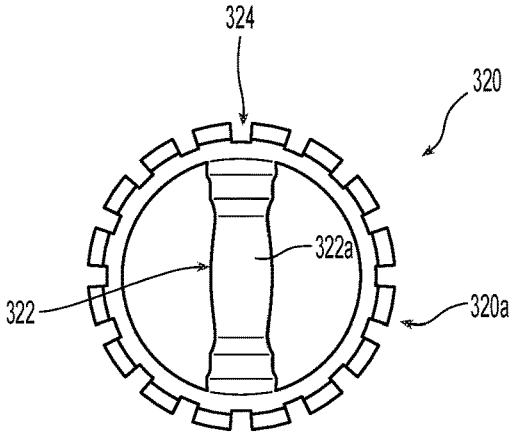
FIG. 24 is a front view of the grip of FIG. 23.
Figure 25:
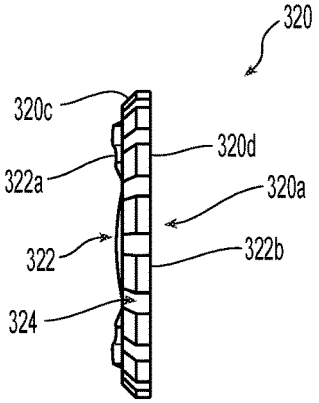
FIG. 25 is a side view of the grip of FIG. 23.
Figure 26:
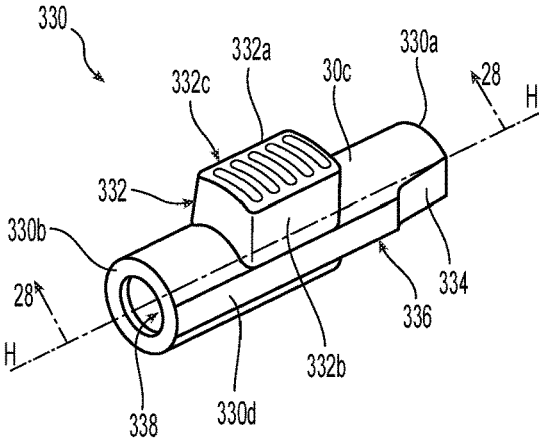
FIG. 26 is a perspective view of a ratchet pawl of the handle assembly of FIG. 21.
Figure 27:
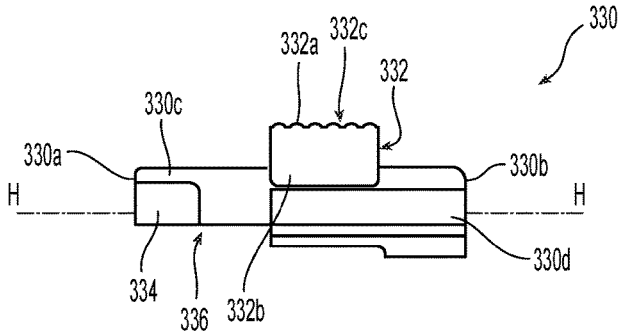
FIG. 27 is a side view of the ratchet pawl of FIG. 26.

With reference to FIGS. 23-25, the grip 320 includes first and second half-sections 320*a*, 320*b* (FIG. 20), each defining a generally hemitoroidal configuration such that the first and second half-sections 320*a*, 320*b* form a toroid when placed adjacent one another (e.g., in a mirrored fashion). The first half-section 320*a* is substantially similar to the second half-section 320*b*, and therefore only the first half-section 320*a* will be described in detail in the interest of brevity.

The first half-section 320*a* defines an arcuate first surface 320*c* (FIG. 23) and a planar second surface 320*d* (FIG. 25) opposite to the arcuate first surface 320*c*. Although generally illustrated as having an arcuate first surface, it is contemplated that the first half-section 320*a* may define any suitable configuration capable of being rotatably secured within the first and second half-sections 310*a* of the housing assembly 310, as will be described in further detail hereinbelow.

The first half-section 320*a* includes a grip member 322 extending between diametrically opposed points defined on an interior diameter of the first half-section 320*a*. The grip member 322 includes a generally contoured upper surface 322*a* and a planar bottom surface 322*b* (FIG. 25). As can be appreciated, the contoured upper surface 322*a* is configured to be grasped by the user, and therefore, may include any suitable profile capable of providing a comfortable grip and enabling the user to securely grasp the grip 320. The planar second surface 320*d* of the first half-section 320*a* defines a plurality of slots 324 therethrough and extending through the arcuate first surface 320*c*. The plurality of slots 324 is disposed adjacent an outer circumference of the first half-section 320*a* and extends through a radially outward-most portion thereof. Although generally illustrated as defining a rectangular configuration, it is contemplated that each slot of the plurality of slots 324 may define any suitable configuration capable of retaining a portion of the ratchet pawl 330 therein to inhibit rotation of the grip 320. The plurality of slots 324 are disposed 22.5 degrees from one another about the circumference of the planar second surface 320*d*, such that the plurality of slots 324 includes sixteen slots. As can be appreciated, the number of slots of the plurality of slots 324 defines the number of radial locations at which the ratchet pawl 330, and therefore the grip 320, may be oriented relative to the handle housing 310. In embodiments, the plurality of slots 324 may include any suitable number of slots, depending upon the number of radial positions at which the grip 320 is intended to be placed.

In embodiments, the arcuate first surface 320*c* of the first half-section 320*a* may include an indicator thereon capable if indicating to the user which hand is intended to be used therewith. In one non-limiting embodiment, the indicator is the letter "R" to indicate use with the user's right hand, and the indicator "L" to indicate use with the user's left hand. As can be appreciated, any suitable indicator may be used that is capable of indicating to the user which hand to use with the respective grip 320, and in embodiments, no indicator may be utilized.

It is contemplated that the first and second half-sections 320*a*, 320*b* of the grip 320 may be formed from any material having suitable stiffness and durability for use in a weight training environment, such as metallic, non-metallic, composite, or the like and may be cast, injection molded, machined, etc. In one non-limiting embodiment, the first and second half sections 320*a*, 320*b* are formed from an injection molded non-metallic material.

Turning now to FIGS. 26-29, the ratchet pawl 330 defines an elongated body extending between first and second end surfaces 330*a* and 330*b*, defining a longitudinal axis H-H. Although generally illustrated as defining a generally cylindrical configuration, it is contemplated that the ratchet pawl 330 may define any suitable configuration such as elliptical, oval, square, rectangular, hexagonal, etc. An outer surface 330*c* of the elongated body defines a protrusion 332 thereon at a middle portion thereof and extending radially outward therefrom. The protrusion 332 defines a generally rectangular profile when viewed in a plan view, although it is contemplated that the protrusion 332 may define any suitable profile, such as circular, oval, elliptical, etc. The protrusion 332 defines an upper surface 332*a* and opposed side surfaces 332*b* extending between the outer surface 330*c* of the elongated body and the upper surface 332*a*. The upper surface 332*a* defines a plurality of slots 332*c* thereon configured to enhance the ability of a user to grip the ratchet pawl 330 during use. In embodiments, the upper surface 332*a* may define any suitable configuration capable of providing increased grip to the user, such as a crenellated surface, a plurality of protrusions, etc. As will be described in further detail hereinbelow, the protrusion 332 is configured to be received within the window 312*n* of the handle housing 310 such that a user is permitted to manipulate the ratchet pawl 330 to adjust the radial position of the grip relative to the handle housing 310.

Figure 29:
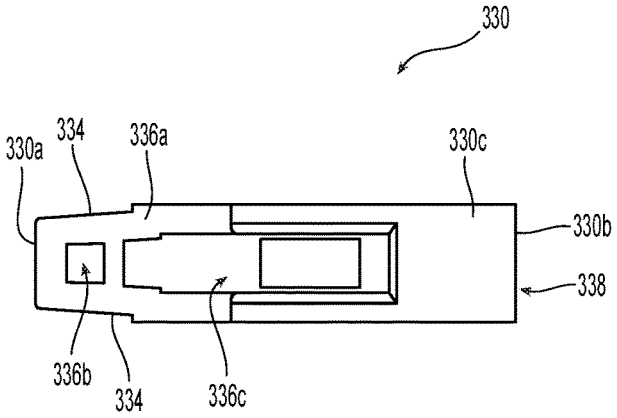
FIG. 29 is a bottom view of the ratchet pawl of FIG. 26.

The outer surface 330*c* of the elongated body defines a pair of opposed flats 330*d* thereon extending along the longitudinal axis H-H that are generally co-planar with the opposed side surfaces 332*b* of the protrusion 332. Adjacent the first end surface 330*a*, the outer surface 330*c* of the elongated body defines a pair of tapered flats 334 extending along the longitudinal axis H-H and extending through the first end surface 330*a* (FIG. 29). The pair of tapered flats 334 are defined on the outer surface 330*c* such that the pair of tapered flats 334 approximate one another in a longitudinal direction towards the first end surface 330*a*. The pair of tapered flats 334 are configured to be selectively received within a respective slot of the plurality of slots 324 of the grip 320.

Figure 28:
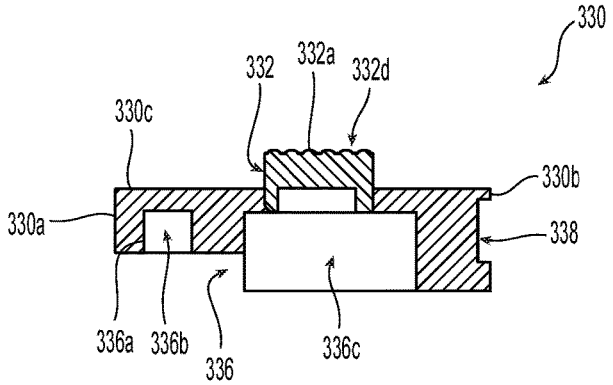
FIG. 28 is a side, cross-sectional view of the ratchet pawl of FIG. 26, taken along section line 28-28 of FIG. 22.

The first end surface 330*a* defines a cutout 336 therein extending along the longitudinal axis H-H and is oriented opposite the protrusion 332 and defines a planar surface 336*a*. The planar surface 336*a* defines a cavity 336*b* therein adjacent the first end surface 330*a* and a channel 336*c* adjacent to and longitudinally spaced from the cavity 336*b* toward the second end surface 330*b*. The channel 336*c* extends along the longitudinal axis H-H towards the second end surface 330*b* and terminates approximately two-thirds of the length of the elongated body from the first end surface 330*a*. As illustrated in FIGS. 28 and 29, the channel 336*c* extends radially outward opposite the protrusion 332 and through the outer surface 330*c* of the elongated body. The channel 336*c* is configured to slidably receive the longitudinal tab 314*n* of the handle housing 310, such that the ratchet pawl 330 is inhibited from rotating relative to the handle housing 310. The second end surface 330*b* of the elongated body defines a counterbore 338 (FIG. 26) therein configured to receive a portion of the ratchet pawl biasing element 340 therein. In embodiments, the second end surface 330*b* may be planar and not include a counterbore 338 therein.

It is contemplated that the ratchet pawl 330 may be formed from any material having suitable stiffness and durability for use in a weight training environment, such as metallic, non-metallic, composite, or the like and may be cast, injection molded, machined, etc. In one non-limiting embodiment, the ratchet pawl 330 is formed from an injection molded non-metallic material.

Figure 30:
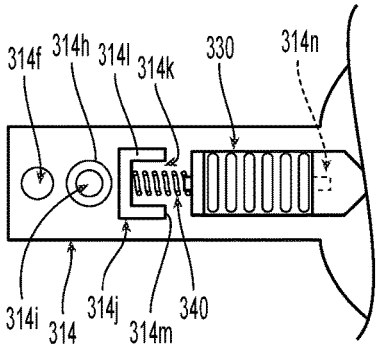
FIG. 30 is an enlarged, cross-sectional view of a leg of the handle assembly of FIG. 21.

As illustrated in FIG. 30, the ratchet pawl biasing element 340 is interposed between the second end surface 330*b* of the ratchet pawl 330 and the protrusions 312*j*, 314*j* such that the ratchet pawl biasing element 340 biases the ratchet pawl 340 into engagement with the plurality of slots 324 of the grip 320. Although generally illustrated as being a coil spring, it is contemplated that the ratchet pawl biasing element may be any suitable biasing element such as a leaf spring, an elastomer spring, a Bellville washer or a plurality of Bellville washers, etc.

With reference to FIGS. 18 and 31A-31C, in operation, the user places the desired weight plates or barbell plates (not shown) over the outer surface 22*c* of the weight support 20 until the interior most weight plate abuts the radially extending flange 24. Once the desired number of weight plates are placed on the weight support 20, a barbell clamp (not shown) or other suitable device capable of retaining the weight plates on the weight support 20 is placed over the outer surface 22*c* of the weight support 20 and secured thereto to retain the weight plates on the weight support 20. This process is repeated for the remaining weight support 20 until the desired weight is supported on the weight supports 20.

Figure 31A:
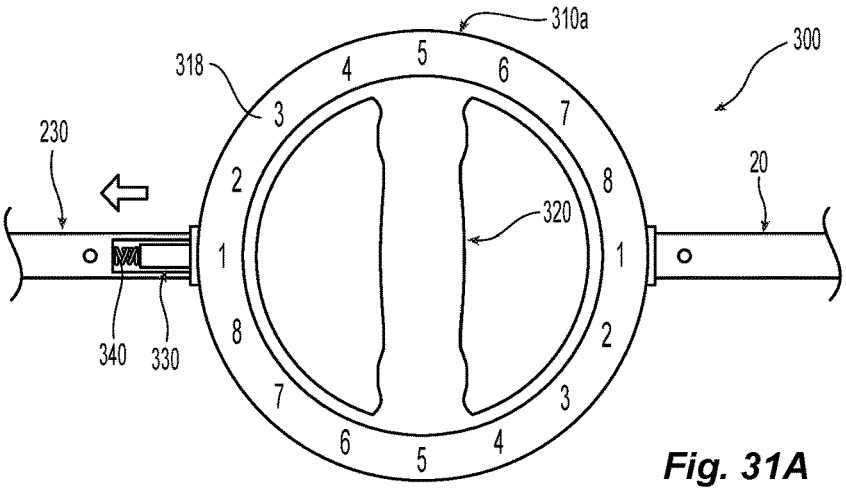
FIG. 31A is a front view of the handle assembly of FIG. 21 shown with the ratchet pawl of FIG. 26 in an initial state.
Figure 31B:
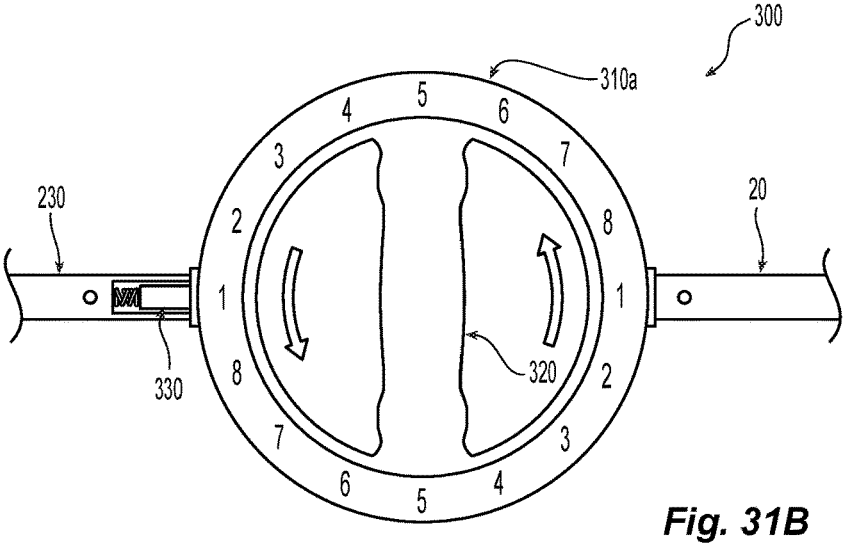
FIG. 31B is a front view of the handle assembly of FIG. 21 shown with the ratchet pawl of FIG. 26 in a retracted state.
Figure 31C:
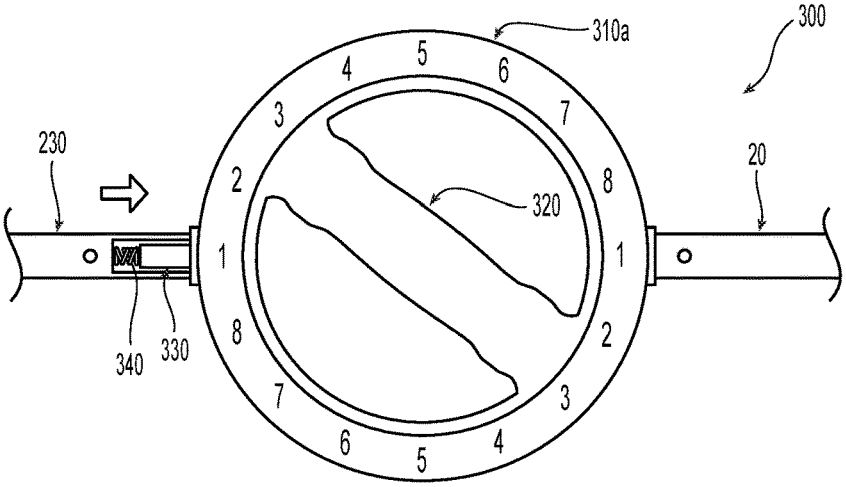
FIG. 31C is a front view of the handle assembly of FIG. 21 shown with the grip of FIG. 23 rotated from its initial state.

At this point, the user grasps one grip 320 of the handle assemblies 300 with one hand, and uses a finger, such as thumb, to retract the ratchet pawl 330 associated with the grip 320 that is grasped by the user. In this manner, the user pulls the ratchet pawl 330 away from the grip 320 to compress the ratchet pawl biasing element 340 and disengage the ratchet pawl 330 from the plurality of slots 324 of the grip 320 (FIG. 31A). Once the ratchet pawl 330 is disengaged from the plurality of slots 324, the user may rotate the grip 320 relative to the handle housing 310 (FIG. 31B) to place the grip 320 in the desired position (e.g., "1," "2," "3," "4," "5," "6," "7," or "8") (FIG. 31C). This process is repeated for the remaining grip 320 and may be repeated as many times as desired by the user. As can be appreciated, the user may place each grip 320 in a different position relative to one another (e.g., the right grip 220 may be placed in position "1" whereas the left grip 320 may be placed in position "4" or any combination thereof) depending upon which muscles the user intends to target.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments.

As used in the drawings and in the description hereinabove, terms such as front, rear, upper, lower, top, bottom, and similar directional terms are used simply for convenience of description and are not intended to limit the disclosure. In the description hereinabove, well-known functions or constructions are not described in detail to avoid obscuring the present disclosure in unnecessary detail.

What is claimed is:

1. A weight lifting apparatus, comprising:

a pair of weight supports;

a pair of handle assemblies each coupled to the pair of weight supports, the pair of handle assemblies including:

a handle housing defining a pair of housing half-sections, each of the pair of housing half-sections defining an arcuate first surface and a planar second surface disposed opposite to the arcuate first surface;

a grip rotatably supported within the handle housing; and a ratchet pawl slidably disposed within a portion of the grip, the ratchet pawl selectively manipulatable from a first position that inhibits rotation of the grip relative to the handle housing to a second position that permits rotation of the grip relative to the handle housing; and a central bar interposed between each handle assembly of the pair of handle assemblies and coupled thereto.

2. The weight lifting apparatus according to claim 1, wherein the ratchet pawl is slidably disposed within a portion of the center bar.

3. The weight lifting apparatus according to claim 2, wherein the arcuate first surface of each of the handle housing half-sections defines a pair of diametrically opposed legs extending radially outward therefrom.

4. The weight lifting apparatus according to claim 3, wherein a leg of the pair of diametrically opposed legs defines an arcuate first surface and a planar second surface disposed opposite thereto.

5. The weight lifting apparatus according to claim 4, wherein the planar second surface of the leg of the pair of diametrically opposed legs defines a cavity therein, an inner surface of the cavity defining a longitudinal tab thereon configured to be received within a portion of the ratchet pawl such that the ratchet pawl is permitted to translate thereon but not rotate relative thereto.

6. The weight lifting apparatus according to claim 5, wherein the inner surface of the cavity defines a protrusion thereon having a relief defined therein, the relief configured to receive a portion of a ratchet pawl biasing element therein.

7. The weight lifting apparatus according to claim 6, wherein the ratchet pawl biasing element is interposed between the relief and the ratchet pawl to bias the ratchet pawl into engagement with the plurality of slots of the grip.

8. The weight lifting apparatus according to claim 2, wherein the grip defines a pair of half-sections, each of the pair of half-sections defining an arcuate first surface and a planar second surface disposed opposite to the arcuate first surface.

9. The weight lifting apparatus according to claim 8, wherein the planar second surface defines a plurality of slots therein extending through the arcuate first surface and arranged circumferentially thereon.

10. The weight lifting apparatus according to claim 9, wherein each of the slots of the plurality of slots is spaced apart from one another, each slot of the plurality of slots configured to receive a portion of the ratchet pawl therein to inhibit rotation of the grip relative to the handle housing.

11. The weight lifting apparatus according to claim 1, wherein the planar second surface defines a counterbore therein, an inner surface of the counterbore defining a plurality of bosses extending therefrom and arranged circumferentially thereon.

12. The weight lifting apparatus according to claim 11, wherein each boss of the plurality of bosses is spaced apart from one another to form a corresponding plurality of channels therebetween, wherein when in the first position, the ratchet pawl is configured to be received within a channel of the corresponding plurality of channels to inhibit rotation of the grip relative to the handle housing.

13. The weight lifting apparatus according to claim 11, wherein each boss of the plurality of bosses is spaced apart from one another to form a corresponding plurality of channels therebetween, and the weight lifting apparatus further includes a ratchet pawl biasing element interposed between the ratchet pawl and a surface of the slot of the grip, the ratchet pawl biasing element configured to bias the ratchet pawl into engagement with a channel of the corresponding plurality of channels of the handle housing half-sections.

14. The weight lifting apparatus according to claim 1, wherein an outer surface of the grip defines a slot therein configured to slidably receive the ratchet pawl therein.

* * * * *